US007125389B2

(12) United States Patent
Sin

(10) Patent No.: US 7,125,389 B2
(45) Date of Patent: Oct. 24, 2006

(54) SPINAL MASSAGER

(76) Inventor: Hyunkwon Sin, 134-8, Gundong-ri, Jiksan-eup, Cheonan-si, Chungcheongnam-do (KR) 330-811

( * ) Notice: Subject to any disclaimer, the term of this patent is extended or adjusted under 35 U.S.C. 154(b) by 0 days.

(21) Appl. No.: 11/168,303

(22) Filed: Jun. 29, 2005

(65) Prior Publication Data

US 2006/0015046 A1 Jan. 19, 2006

(30) Foreign Application Priority Data

Jul. 16, 2004 (KR) ..... 10-2004-0055476

(51) Int. Cl.
*A61H 7/00* (2006.01)
*A63B 26/00* (2006.01)

(52) U.S. Cl. ..... 601/98; 601/84; 601/100; 601/101; 482/144

(58) Field of Classification Search ..... 601/23, 601/24, 26, 84, 86, 87, 97, 98, 100–103, 601/107, 108, 110, 112, 113, 116; 606/241, 606/242; 482/143, 144, 14
See application file for complete search history.

(56) References Cited

U.S. PATENT DOCUMENTS 6,149,560 A * 11/2000 Kim ..... 482/144
6,960,174 B1 * 11/2005 Fenkel ..... 606/241
7,037,279 B1 * 5/2006 Kim ..... 601/98
7,052,448 B1 * 5/2006 Teeter ..... 482/144

* cited by examiner

*Primary Examiner*—Quang D. Thanh
(74) *Attorney, Agent, or Firm*—Bacon & Thomas

(57) ABSTRACT

Disclosed herein is spinal massager capable of performing oscillating or chiropractic operation along the vertebrae of a user who lies on the massager with the feet elevated above the head. The spinal massager allows a herniated spinal disc to be readily restored into a gap produced between the vertebrae, resulting in improved blood circulation and muscle relaxation.

4 Claims, 5 Drawing Sheets

Prior Art

SPINAL MASSAGER

BACKGROUND OF THE INVENTION

1. Field of the Invention

The present invention relates to a spinal massager, and, more particularly, to a spinal massager which can perform oscillating or chiropractic operation along the vertebrae of a user, who lies thereon with the feet elevated above the head, to thereby allow a herniated spinal disc to be readily restored into a gap produced between the vertebrae, resulting in improved blood circulation and muscle relaxation.

2. Description of the Related Art

Recently people are increasingly health conscious and set aside time to exercise, and thus, spend generous time and money to enhance their physical health. In response to this trend, people spend their holidays to eliminate mental and physical exhaustion and to relax their stress. In the case of officer workers, the mental and physical exhaustion tends to be caused by their poor working posture. Since men have an upright walking posture, they often suffer from disorder of the neck, waist, or back, i.e. diseases associated with spinal discs. The vertebral column is comprised of seven cervical vertebrae, twelve thoracic vertebrae, five lumbar vertebrae, a sacrum, and three to six coccyges. Spinal discs are composed of cartilage present between vertebrae and serve as cushions for absorbing shock. Such a spinal disk, as a kind of a joint, consists of the nucleus pulposus approximately 80% of which is water and which is gelatinous, and the annulus fibrous that is a fibrous material which surrounds and protects the nucleus pulposus. As is well known, the vertebral column is an important organ through which central nerves pass, and the spinal disc attenuates the weight and impact of the body. Sturdy ligamentous tissues surround the spinal disc to enable the vertebrae to function properly through its roles of weight distribution or absorption. Surrounded by the sturdy ligamentous tissues, the disc is difficult to be thrust.

However, once any one of the vertebrae is crooked due to external stimulus resulting from poor posture or an accident, the spinal disc between the vertebrae is pressurized, thus being forced outside of the vertebrae. In this case, the slipped disc stimulates neighboring nerve roots, inducing pain, and ligaments and muscles are stiffened to prevent the vertebrae from being further crooked. This phenomenon is called a "disc-related diseases" or "herniated disc". Among the diseases, the herniated lumbar disc results from when the disc located between the lumbar vertebrae is pushed to press neighboring nerves, producing pain. Medical treatments of the herniated lumbar disc include surgical operations to correct the crooked vertebrae, or physical therapy that is frequently performed to physically correct the crooked vertebrae. Here, physical therapy is performed to push the crooked vertebrae upward against a downward pressure.

To remedy and correct poor posture, an exercise machine using a handstand posture has been recently developed. The handstand exercise machine (hereinafter, referred to as "spinal massager") will now be explained with reference to FIG. 1.

Referring to FIG. 1, there is illustrated a conventional spinal massager 2 in a perspective view. The conventional spinal massager 2 basically comprises a lower structure 10 as a supporting stand of the spinal massager 2, a saddle 22 mounted at an upper portion of the lower structure 10 to allow a user to be hung down in a handstand posture, and a feet holder 30.

More specifically, the lower structure 10 includes a front support frame 12 and a rear support frame 18, which generally have a trapezoidal cross section, and are made up of square bars. The rear support frame 18 is hinged to an upper end of the front support frame 12 to have a predetermined angle therebetween.

A horizontal support bar 14 is welded to a certain upper portion of the front support frame 12 to be connected between opposite lateral portions of the front support frame 12. A length-adjustment vertical bar 24 is coupled to the center of the horizontal support bar 14. Also, a pair of handles 16 is coupled, respectively, to upper ends of the opposite lateral portions of the front support frame 12 to assist the user to lie down or lift his/her upper body. An angle adjustor 20 is provided at the front support frame 12 near one of the handles 16. Both the horizontal support bar 14 and the length-adjustment vertical bar 24 are attached to a lower surface of the saddle 22. Also, the saddle 22 is provided at the lower surface thereof with a length-adjustment pin 28.

The feet holder 30 includes a plurality of feet holding rods 32 provided at a distal end of the length-adjustment vertical bar 24 to catch the user's feet therebetween, a sole support 34 coupled at a distal end thereof, and an ankle-tightening adjustor rod 36 to adjust a distance between the feet holding rods 32 to appropriately tighten the user's ankle.

With this configuration, in an initial state with the saddle 22 elevated above the feet holder 30, as the user puts the back on the saddle 22 and forcibly pushes the saddle 22 down while gripping the handles 16, the saddle 22 is able to be overturned, allowing the user to be hung down in a handstand posture.

As is well known, the handstand posture has several advantages in that it can remove weight applied to cartilage tissues by the user's weight and straightens the crooked vertebrae resulting from bad posture to thereby stretch the height of the user. Also, the handstand posture is effective to reduce abdominal fat to thereby achieve fine physical figure, and shows excellent effect to remedy cold hands and feet. In addition, the handstand posture can prevent or remedy various adult-onset diseases, such as arteriosclerosis and myocardial infarction, and can relieve fatigue and stress by stretching of muscles.

However, the conventional spinal massager 2 merely allows the user to be hung down in a handstand posture, and achieves only meager effect. That is, since it is difficult to overturn the saddle of the spinal massager, a relatively long time is required to restore any herniated disc into a space produced between vertebrae by virtue of the handstand posture.

SUMMARY OF THE INVENTION

Therefore, the present invention has been made in view of the above problems, and it is an object of the present invention to provide a spinal massager which can perform oscillating or chiropractic operation along the vertebrae of a user, who lies thereon with the feet elevated above the head, to thereby allow a herniated spinal disc to be readily restored into a gap produced between the vertebrae, resulting in improved blood circulation and muscle relaxation.

In accordance with the present invention, the above and other objects can be accomplished by the provision of a spinal massager comprising: a lower structure having rectangular frames; a saddle mounted at an upper portion of the lower structure to bear the user's back at an upper surface thereof; a length-adjustment vertical bar connected to the saddle to support the saddle; and a feet holder located at an end of the length-adjustment vertical bar to catch the user's feet, further comprising: a transfer drive unit to transfer a hitting head, mounted inside the saddle, along the vertebrae; a hitting drive unit mounted inside the saddle to be transferred by the transfer drive unit and adapted to drive the hitting head to hit the vertebrae; a key operating panel mounted on a side of the saddle to generate various key signals to induce hitting and transfer operations; a memory to store preset signals from key buttons of the key operating panel and motor drive data depending on the preset signals from the key buttons; and a controller to generate control signals to drive both the transfer drive unit and the hitting drive unit upon receiving the preset signals from the key buttons of the key operating panel, thereby allowing the hitting head to hit the vertebrae while being transferred along the vertebrae within the saddle under control of the controller, whereby the spinal massager massages the vertebrae of a user, who lies thereon with the feet elevated above the head, with a predetermined constant strength, thereby allowing a herniated spinal disc to be readily restored into a gap produced between the vertebrae.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be explained in detail with reference to the accompanying drawings.

Figure 1:
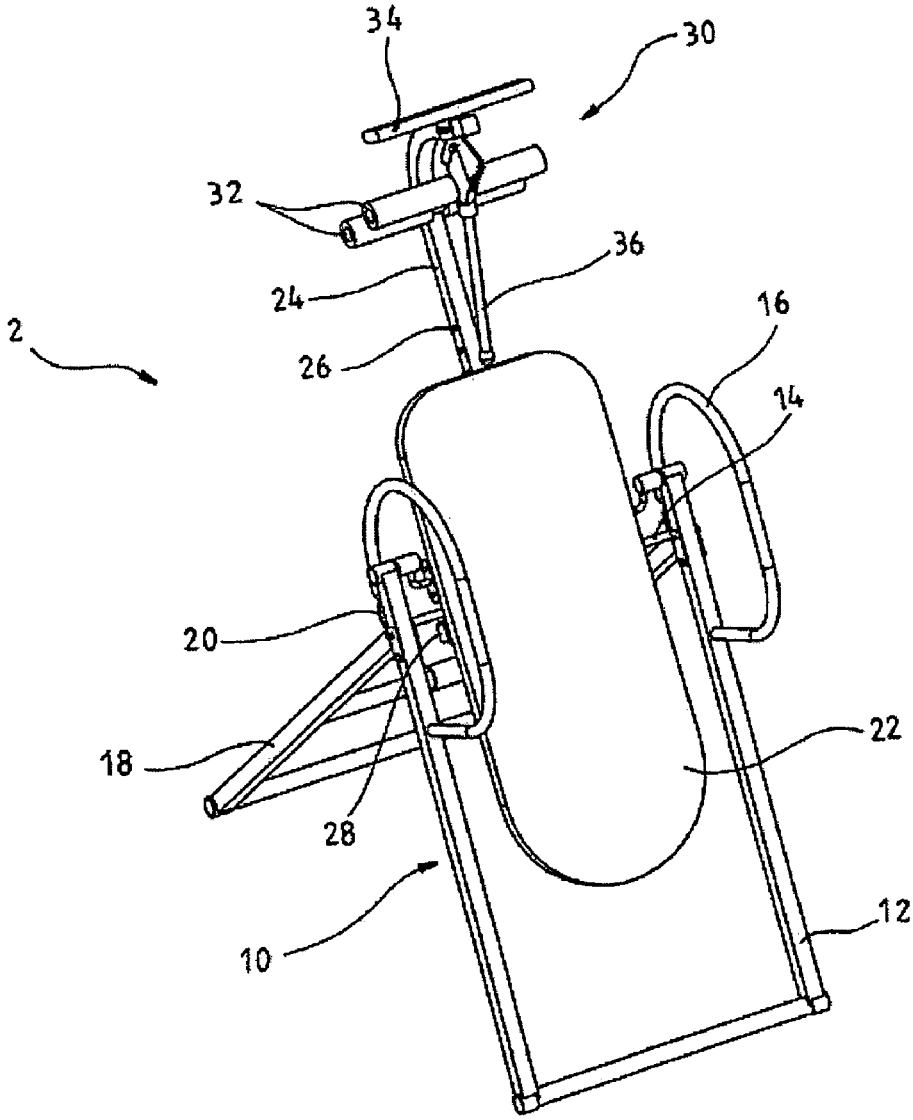
FIG. 1 is a perspective view of a conventional spinal massager.
Figure 2:
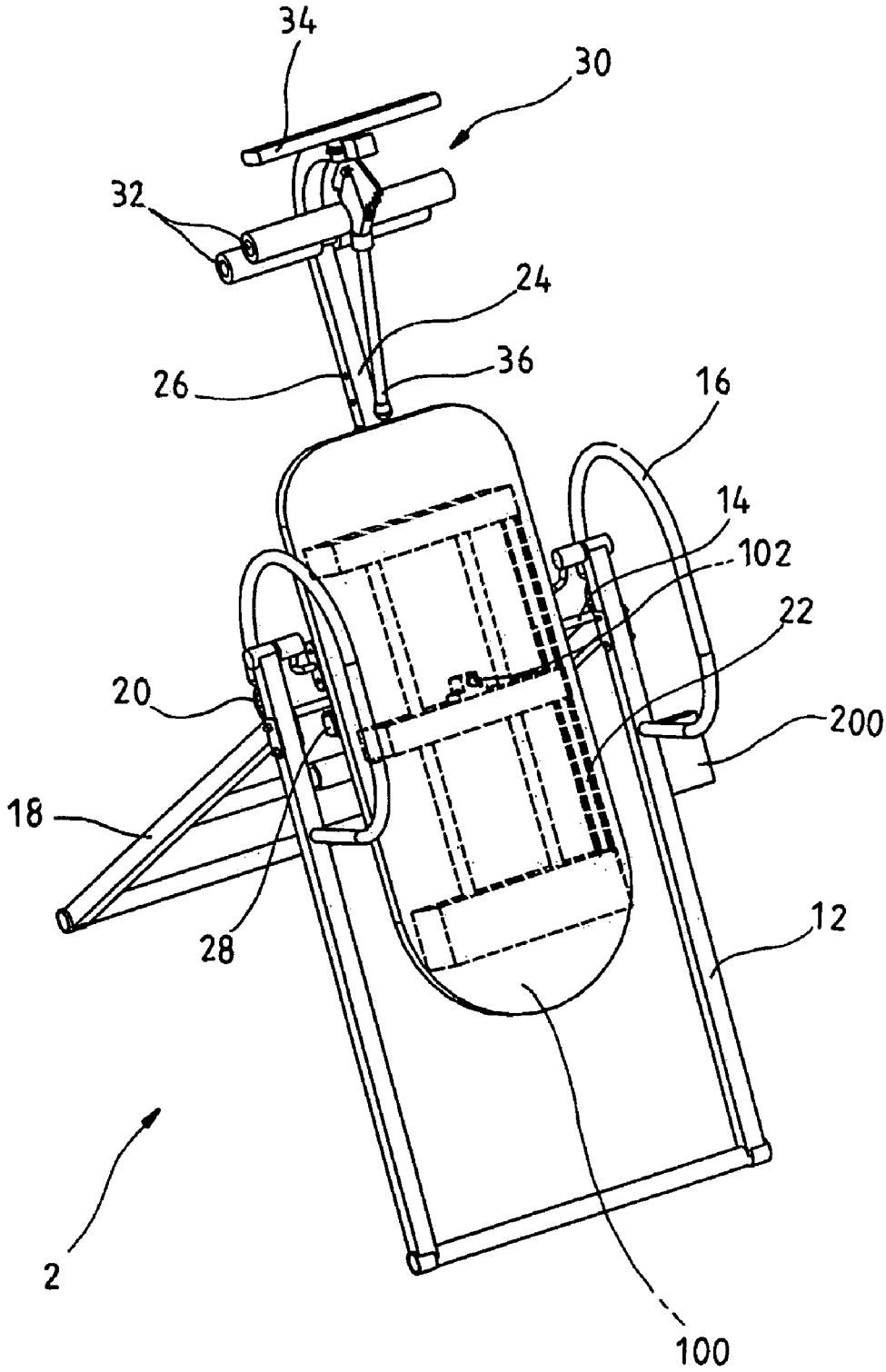
FIG. 2 is a perspective view illustrating the general configuration of a spinal massager according to an embodiment of the present invention.

FIG. 2 is a perspective view illustrating the general configuration of a spinal massager according to an embodiment of the present invention, which contains a massage device therein. Referring to FIG. 2, the spinal massager according to the embodiment of the present invention, designated as reference numeral 2', is identical to the conventional spinal massager as stated above with reference to FIG. 1 except that it comprises a massage device 100. The massage device 100 is mounted inside the saddle 22, and has a hitting head 102. Considering operation of the massage device 100 in brief, in a state wherein the user is hung down in a handstand posture, the hitting head 102 is operated to hit the vertebrae with a predetermined constant strength while vertically moving along the vertebrae. Hitting the vertebra allows a herniated spinal disc to be more readily inserted and restored into a gap produced between the vertebrae by virtue of the handstand posture.

The spinal massager 2' according to the embodiment of the present invention further comprises a key operating panel 200 provided at a lateral portion of the front support frame 12 to generate various key signals to drive the massage device 100.

Figure 3:
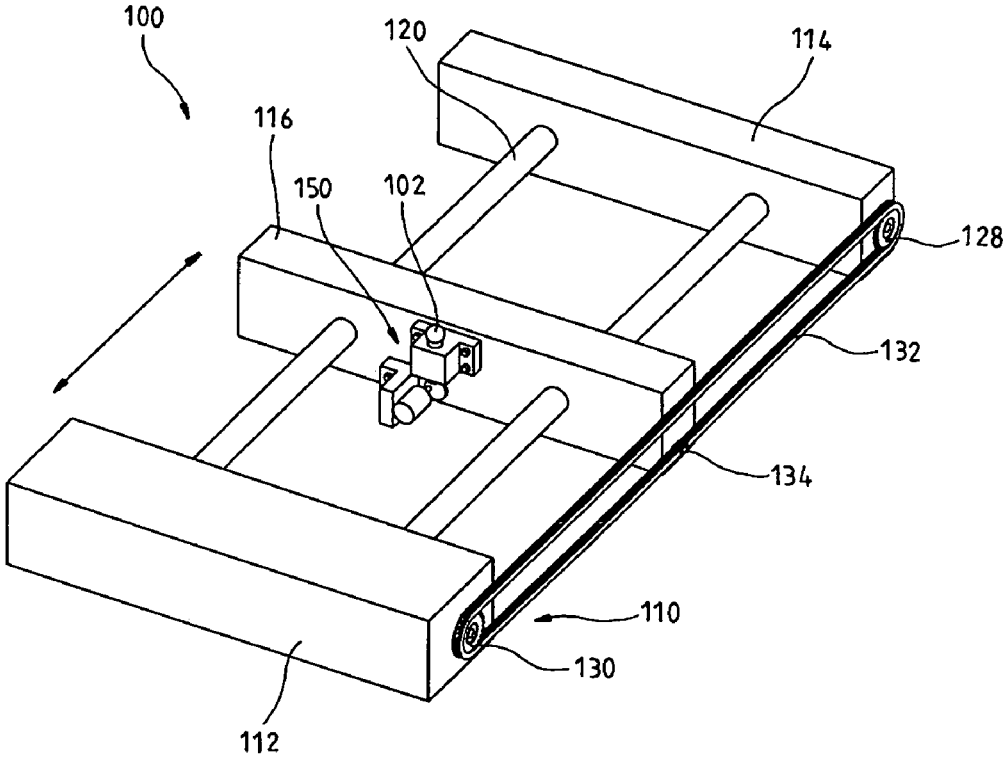
FIG. 3 is a perspective view illustrating a massage device of the spinal massager according to the embodiment of the present invention.
Figure 4A:
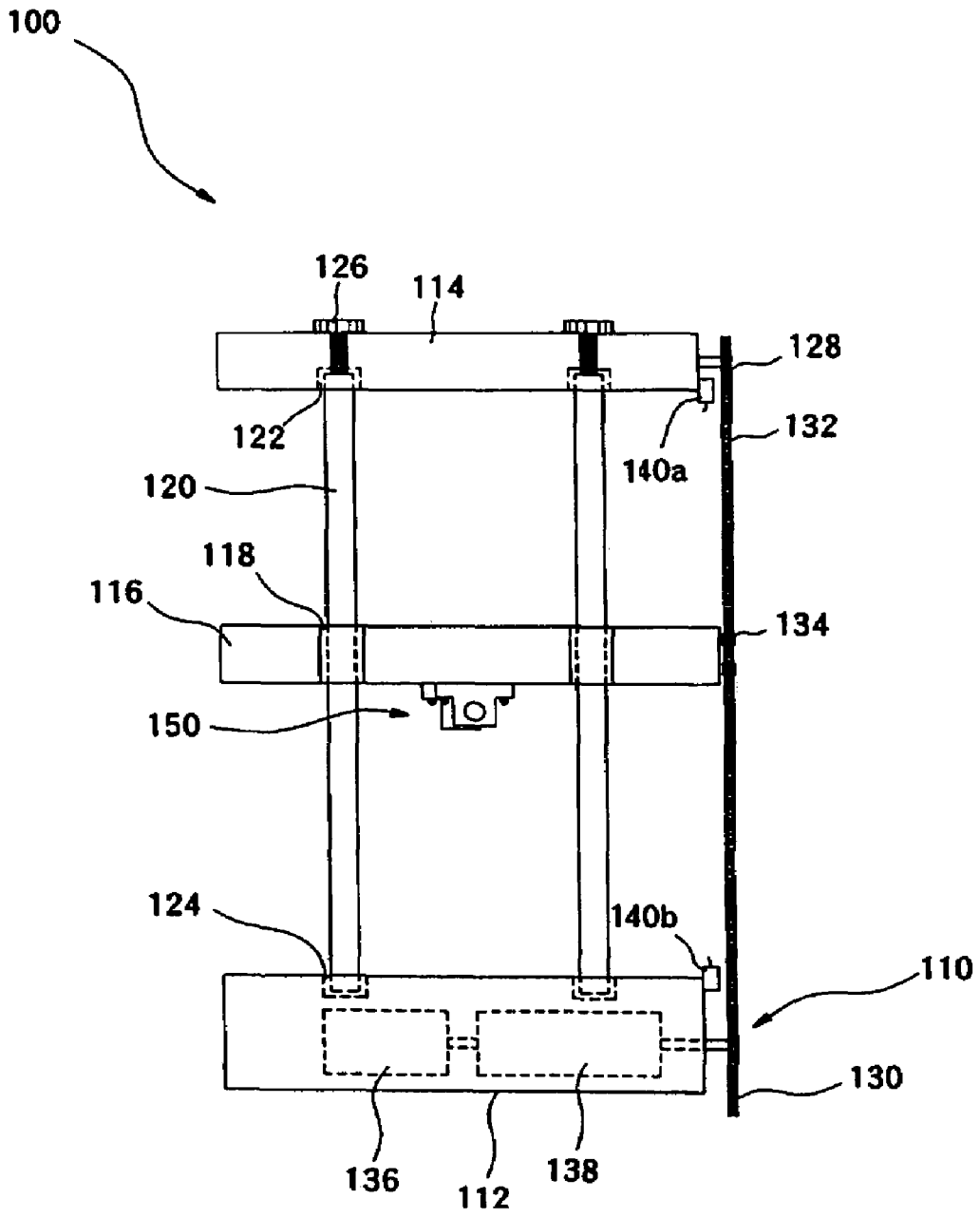
FIG. 4*a* is a plan sectional view illustrating a transfer drive unit of the spinal massager according to the embodiment of the present invention.

FIG. 3 is a perspective view illustrating the configuration of the massage device according to the embodiment of the present invention. FIG. 4*a* is a plan sectional view illustrating a transfer drive unit of the spinal massager according to the embodiment of the present invention.

Referring to FIGS. 3 and 4*a*, the massage device 100 basically includes a transfer drive unit 110 to longitudinally transfer the hitting head 102 inside the saddle 22, and a hitting drive unit 150 mounted on a sliding block 116 of the transfer drive unit 110 to induce a hitting operation on the vertebrae.

The transfer drive unit 110 includes a rectangular box-shaped motor housing 112, a transfer motor 136 mounted inside the motor housing 112 to generate a driving force required to transfer the sliding block 116, and a supporting block 114 spaced apart from the motor housing 112 by a predetermined distance to face the motor housing 112. In this case, facing surfaces of the motor housing 112 and the supporting block 114 have the same area as each other. Holes 122 and 124 are formed at the facing surfaces of the supporting block 114 and the motor housing 112, respectively, so that a plurality of elongated guide rods 120 may be inserted into the holes 122 and 124. A plurality of fastening bosses 126 is coupled to the other surface of the supporting block 114 opposite to the motor housing 112 so that each of the bosses 126 is coupled to an end of each guide rod 120. In this way, the guide rods 120 are fixed to the supporting block 114.

The sliding block 116 is located between the motor housing 112 and the supporting block 114 in a slidable manner. The sliding block 116 is formed, along a center longitudinal axis thereof, with a plurality of through-holes 118 to allow passage of the guide rods 120. As a result, the guide rods 120 penetrate the sliding block 116 to guide a longitudinal sliding movement of the sliding block 116.

A first gear 128 is coupled to a lateral surface of the supporting block 114 by interposing a bearing (not shown), and a second gear 130 is coupled to the motor housing 112 at a corresponding lateral surface of the motor housing 112. Both the first and second gears 128 and 130 are coupled to each other by making use of a chain 132. The sliding block 116 is also coupled to the chain 132 by means of a fastening hook 134. Thereby, the sliding block 116 is synchronously movable along with the chain 132.

Inside the motor housing 112 is further mounted a reduction gear 138, which is coupled to a shaft of the transfer motor 136. The reduction gear 138 serves to reduce a gear ratio to thereby double a driving force from the shaft of the transfer motor 136. The reduction gear 138 has well known configuration, and thus, a detailed description thereof will be omitted. A longitudinal shaft of the reduction gear 138 is coupled to the second gear 130.

Both the supporting block 114 and the motor housing 112 are provided, at predetermined positions of their lateral surfaces, with limit switches 140*a* and 140*b*, respectively. If the sliding block 116 touches a respective one of the limit switches 140*a* and 140*b* as it slides between the motor housing 112 and the supporting block 114, a rotating direction of the transfer motor 136 is reversed, causing the sliding block 116 to linearly move in an opposite direction.

Figure 4B:
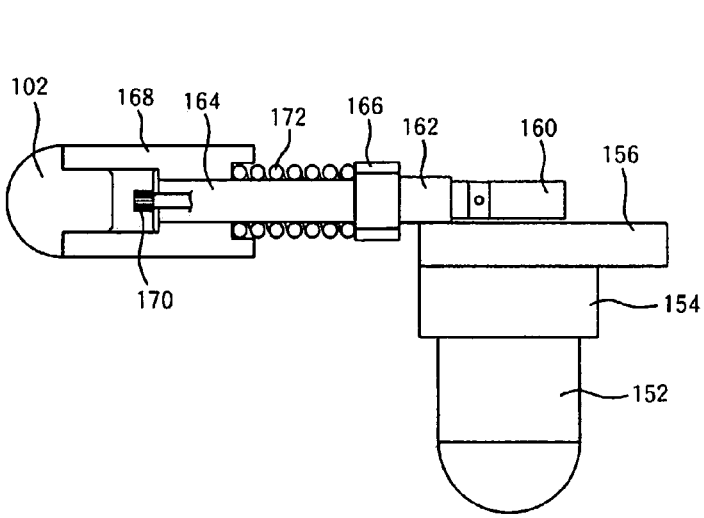
FIG. 4*b* is a side sectional view illustrating a hitting drive unit of the spinal massager according to the embodiment of the present invention.

FIG. 4*b* is a side sectional view illustrating a hitting drive unit of the spinal massager according to the embodiment of the present invention. Referring to FIG. 4*b*, the hitting drive unit 150 is mounted on the sliding block 116 inside the saddle 22 to induce a hitting operation on the vertebrae while longitudinally moving inside the saddle 22. The hitting drive unit 150 includes a hitting motor 152 affixed to one surface of the sliding block 116 by means of a bracket to generate a rotational driving force, a reduction gear 154 mounted on a shaft of the hitting motor 152, and a supporting plate 156 coupled to the reduction gear 154 at an opposite side of the hitting motor 152. A cam 160 is eccentrically coupled to a shaft of the reduction gear 154 that is penetrated through a hole (not shown) centrally formed at the supporting plate 156.

A hitting plate 162 is located to be spaced apart from the cam 160 by a predetermined distance. The hitting plate 162 serves to convert a rotating movement into a linear movement as it repeatedly comes into close contact with the cam 160 or is released from the cam 160. A hitting rod 164 is coupled to the center of the hitting plate 162. Both the hitting rod 164 and the hitting plate 162 are movably coupled to opposite sides of a fixed member 166 mounted on the sliding block 116. A head mount 168 is coupled around a distal end portion of the hitting rod 164 by means of a boss 170 so that the hitting head 102 is seated on a distal end of the hitting rod 164. Also, a restoring spring 172 is inserted around the hitting rod 164 between the head mount 168 and the fixed member 166.

Now, the operation of the hitting drive unit 150 configured as stated above will be explained.

If a driving key signal from an external source is applied to the hitting drive unit 150 located at a surface of the sliding block 116, the hitting motor 152 of the hitting drive unit 150 is driven. Upon driving of the hitting motor 152, the reduction gear 154 operates to increase a driving force of the hitting motor 152 while reducing revolutions per minute of the motor 152. Thereby, the increased driving force is used to rotate the cam 160 eccentrically coupled to the reduction gear 154. As a result of eccentric coupling, the cam 160 acts to raise or lower the hitting plate 162 located thereon by a predetermined period as it is rotated. That is, when a larger diameter portion of the cam 160 comes into close contact with the hitting plate 162, the cam 160 acts to raise the hitting plate 162. Conversely, the cam 160 acts to lower the hitting plate 162 when a smaller diameter portion of the cam 160 comes into close contact with the hitting plate 162. In this case, the hitting rod 164 continuously repeats rising and lowing operations while coming into close contact with the cam 160 under operation of the restoring spring 172. The rising and lowering of the hitting rod 164 allows the hitting head 102 located at the end of the hitting rod 164 to continuously hit the vertebrae. This facilitates insertion of any herniated spinal disc between the vertebrae, enabling rapid disc restoration.

Figure 5:
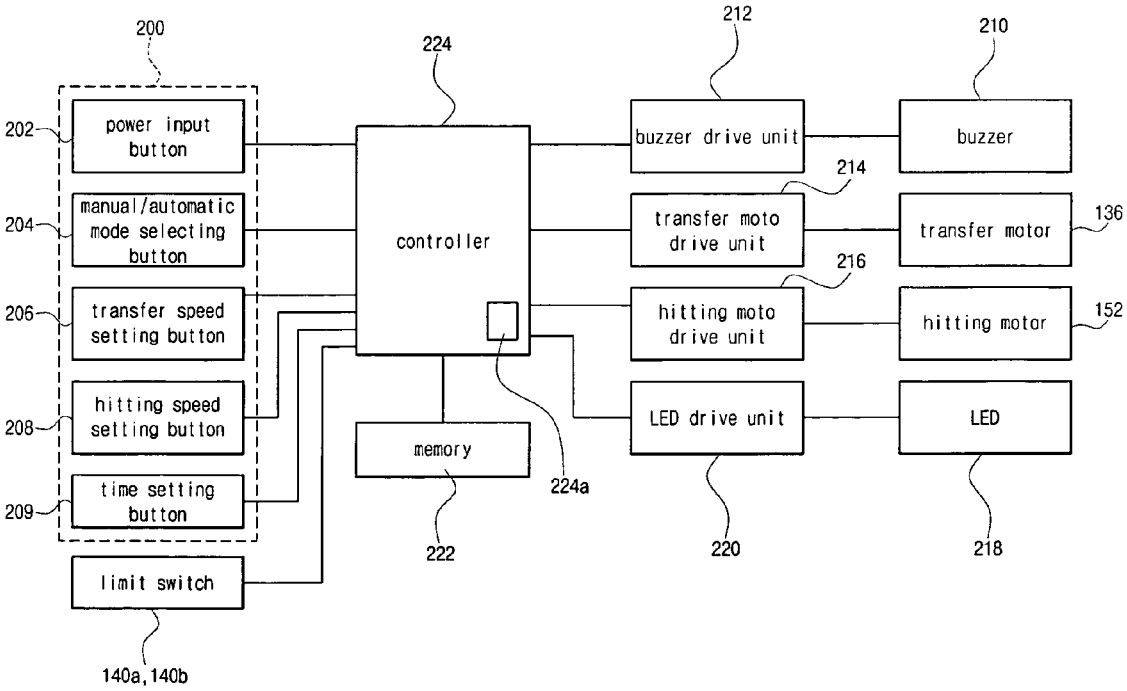
FIG. 5 is a circuit block diagram of the spinal massager according to the embodiment of the present invention.

FIG. 5 is a circuit block diagram of the spinal massager according to the embodiment of the present invention.

Referring to FIG. 5, the spinal massager 2' according to the embodiment of the present invention includes the key operating panel 200 to generate various key signals to drive the massage device 100. The key operating panel 200 has a power input button 202, a manual/automatic mode selecting button 204, a transfer speed setting button 206, a hitting speed setting button 208, and a time setting button 209. When the manual/automatic mode selecting button 204 is set to automatic mode, it generates a signal to allow transfer and hitting operations of the massage device 100 to be automatically performed for a predetermined time even if it is not operated frequently. The transfer speed setting button 206 is a button to set a transfer speed of the sliding block 116 provided thereon with the hitting drive unit 150. The hitting speed setting button 208 is a button to set the number of hitting operations of the hitting head 102 per a second, and the time setting button 209 is a button to set a chiropractic operation time. Also, a buzzer 210 is provided to generate a warning sound informing the advent of the preset chiropractic operation time that is set by the time setting button 209. A buzzer drive unit 212 is provided to drive the buzzer 210. In addition, there are provided the transfer motor 136 to transfer the sliding block 116, the transfer drive unit 110 to drive the transfer motor 136, the hitting motor 152 to generate a driving force required to drive the hitting head 102, and the hitting drive unit 150 to drive the hitting motor 152. In order to display an operational state of the massage device 100, a light emitting diode (LED) 218 and an LED drive unit 220 thereof are additionally provided.

Meanwhile, a memory 222 is provided to store preset signals from the key buttons 202, 204, 206, 208 and 209 as well as motor drive data, i.e. pulse data, depending on the preset signals. Also, a controller 224 is provided to transmit the preset signals from the key buttons 202, 204, 206, 208 and 209 to the memory 222 and to extract pulse signals from the memory 222 to thereby send control signals to the transfer motor 136 and the hitting motor 152. The controller 224 also serves to drive the buzzer 210 if a timer **224*a*** provided therein generates an ending signal.

With this configuration, if a drive mode of the massage device 100 is set via the key operating panel 200 and a driving key signal is generated, first, the hitting motor 152 is driven. Upon driving of the hitting motor 152, the reduction gear 154 operates to increase a driving force of the hitting motor 152 while reducing revolutions per minute of the hitting motor 152. Thereby, the increased driving force is used to rotate the cam 160 eccentrically coupled to the reduction gear 154. As a result of eccentric coupling, the cam 160 acts to raise or lower the hitting plate 162 located thereon by a predetermined period as it is rotated. Simultaneously, the hitting rod 164, coupled to the hitting plate 162, is raised or lowered, allowing the hitting head 102 located at the end of the hitting rod 164 to hit the vertebrae. During the hitting operation induced by the hitting drive unit 150, the transfer drive unit 110 is operated based on a predetermined transfer speed. The operation of the transfer drive unit 110 is initiated from the transfer motor 136. If the transfer motor 136 is driven, a driving force of the transfer motor 136 is transmitted to the second gear 130 by way of the reduction gear 138. Thereby, the second gear 130 is rotated to thereby move the chain 132 coupled around the second gear 130, causing a sliding movement of the sliding block 116 that is also coupled to the chain 132. Thereby, as the sliding block 116 alternately touches a respective one of the limit switches **140*a* and 140*b* when it is moved between the motor housing 112 and the supporting block 114, a rotating direction of the transfer motor 136 is reversed, allowing the sliding block 116** to linearly move in an opposite direction.

As apparent from the above description, the present invention provides a spinal massager which can perform oscillating or chiropractic operation along the vertebrae of a user to thereby allow a herniated spinal disc to be readily restored into a gap produced between the vertebrae, resulting in improved blood circulation and muscle relaxation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A spinal massager comprising: a lower structure; a saddle mounted at an upper portion of the lower structure to bear the user's back at an upper surface thereof, a length-adjustment vertical bar connected to the saddle to support the saddle; and a feet holder located at an end of the length-adjustment vertical bar to catch the user's feet, further comprising:

a transfer drive unit to transfer a hitting head, mounted inside the saddle, along the vertebrae;

a hitting drive unit mounted inside the saddle to be transferred by the transfer drive unit and adapted to drive the hitting head to hit the vertebrae;

a key operating panel mounted on a side of the saddle to generate various key signals to induce hitting and transfer operations;

a memory to store preset signals from key buttons of the key operating panel and motor drive data depending on the preset signals from the key buttons; and a controller to generate control signals to drive both the transfer drive unit and the hitting drive unit upon receiving the preset signals from the key buttons of the key operating panel, thereby allowing the hitting head to hit the vertebrae while being transferred along the vertebrae within the saddle under control of the controller, whereby the spinal massager massages the vertebrae of a user, who lies thereon with the feet elevated above the head, with a predetermined constant strength, thereby allowing a herniated spinal disc to be readily restored into a gap produced between the vertebrae.

2. The spinal massager as set forth in claim 1, wherein the transfer drive unit includes:

a transfer motor to generate a driving force required to transfer the hitting head;

a motor housing containing the transfer motor therein;

a supporting block spaced apart from the motor housing by a predetermined distance to face the motor housing;

one or more guide rods longitudinally connected between the motor housing and the supporting block;

a sliding block provided between the motor housing and the supporting block while being coupled to the guide rods to thereby slide along the guide rods in a longitudinal direction;

a first gear coupled to a lateral surface of the supporting block;

a second gear coupled to a shaft of the transfer motor while being coupled with the first gear by means of a chain;

a fastening hook to couple the chain to a lateral surface of the sliding block; and a reduction gear mounted inside the motor housing while being coupled to the shaft of the transfer motor and adapted to reduce a gear ratio to thereby double a driving force from the shaft of the transfer motor.

3. The spinal massager as set forth in claim 2, wherein a pair of limit switches are attached to predetermined positions of corresponding lateral surfaces of both the motor housing and the supporting block, respectively.

4. The spinal massager as set forth in claim 1, wherein the hitting drive unit includes:

a hitting motor affixed to a surface of the sliding block by means of a bracket and adapted to generate a rotational driving force;

a reduction gear having a first end coupled to a shaft of the hitting motor;

a supporting plate coupled to a second end of the reduction gear and having a center through-hole;

a cam eccentrically coupled to a shaft of the reduction gear;

a hitting plate spaced apart from the cam by a predetermined distance to repeatedly come into close contact with the cam to be displaced according to a trajectory of the cam;

a hitting rod coupled to a center of the hitting plate;

a fixed member to movably affix the hitting rod and the hitting plate relative to the sliding block;

a head mount coupled around a distal end portion of the hitting rod by means of a boss;

the hitting head coupled to a distal end of the hitting rod; and a restoring spring inserted around the hitting rod between the head supporting plate and the fixed member.

* * * * *